US007798346B2

(12) United States Patent
Nelson et al.

(10) Patent No.: US 7,798,346 B2
(45) Date of Patent: Sep. 21, 2010

(54) COMBINATION DRINKING BOTTLE AND CONCENTRATE CONTAINER AND METHOD OF MAKING SAME

(76) Inventors: Steven D. Nelson, 8604 Greenleaf Ave., Buena Park, CA (US) 90620; Leona I. Nelson, 8604 Greenleaf Ave., Buena Park, CA (US) 90620

( * ) Notice: Subject to any disclaimer, the term of this patent is extended or adjusted under 35 U.S.C. 154(b) by 377 days.

(21) Appl. No.: 11/800,016

(22) Filed: May 3, 2007

(65) Prior Publication Data

US 2008/0169259 A1 Jul. 17, 2008

Related U.S. Application Data

(60) Provisional application No. 60/880,001, filed on Jan. 11, 2007, provisional application No. 60/898,630, filed on Feb. 1, 2007.

(51) Int. Cl.
*B65D 1/04* (2006.01)
*B65D 41/04* (2006.01)

(52) U.S. Cl. ..... 215/6; 215/376; 220/23.6; 206/501; 206/821

(58) Field of Classification Search ..... 215/6, 215/10, DIG. 7, DIG. 8, 376; 220/23.6, 714, 220/729; 206/217, 219, 501, 503, 821
See application file for complete search history.

(56) References Cited

U.S. PATENT DOCUMENTS 2,843,281 A * 7/1958 Gallois ..... 215/11.1
3,143,205 A * 8/1964 Ruderian ..... 206/543
3,326,421 A * 6/1967 Peace ..... 222/143
4,327,842 A * 5/1982 Walter ..... 220/254.7
4,779,722 A 10/1988 Hall
5,085,330 A 2/1992 Paulin
5,119,975 A * 6/1992 Jemielita ..... 222/420
5,647,481 A 7/1997 Hundertmark et al.
5,673,789 A * 10/1997 Degraff-Eugene ..... 206/217
5,758,786 A 6/1998 John
6,089,389 A 7/2000 Sharon et al.
6,116,439 A * 9/2000 Yaniv ..... 215/11.1
6,536,453 B2 * 3/2003 Vanden Dries et al. ..... 134/117
6,814,229 B2 11/2004 Seckler
7,042,695 B2 * 5/2006 Przytulla et al. ..... 361/215
2004/0065635 A1 4/2004 Turnbough
2004/0262173 A1 * 12/2004 Buesching et al. ..... 206/217
2006/0102580 A1 * 5/2006 Betras ..... 215/6
2006/0201900 A1 * 9/2006 de Francesco ..... 215/6
2007/0017890 A1 1/2007 Al-Jadh
2008/0156763 A1 * 7/2008 Murphy ..... 215/11.1

OTHER PUBLICATIONS

Flyer, Advanced Dispensing Systems, LLC, Thinking Outside The Bottle, Introducing The Evolution Sports Bottle Taking The Product On The Go, 1 pg., © 2007 Advanced Dispensing Systems, LLC.
Webpage, http://everich.en.aliababa.com/product/50016242/50087181/PC_Bottles/Durable_Sports_PC, Hangzhou Everich Houseware Co., Ltd., Durable Sports PC Water Bottles with CUP, 3 pages, © 1999-2007 Alibaba.com Corporation.

* cited by examiner

*Primary Examiner*—Sue A Weaver
(74) *Attorney, Agent, or Firm*—Fulwider Patton LLP

(57) ABSTRACT

A sports bottle with concentrate cup removably coupled thereto by a female coupling ring.

6 Claims, 7 Drawing Sheets

FIG. 1
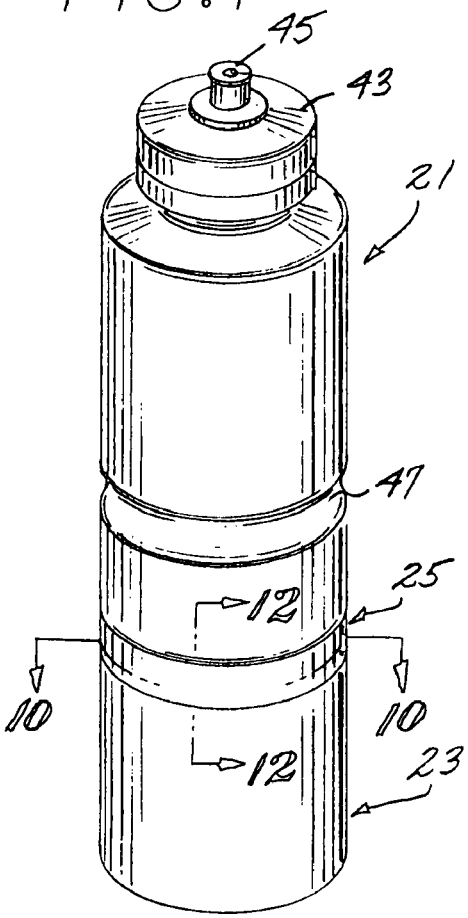
FIG. 2
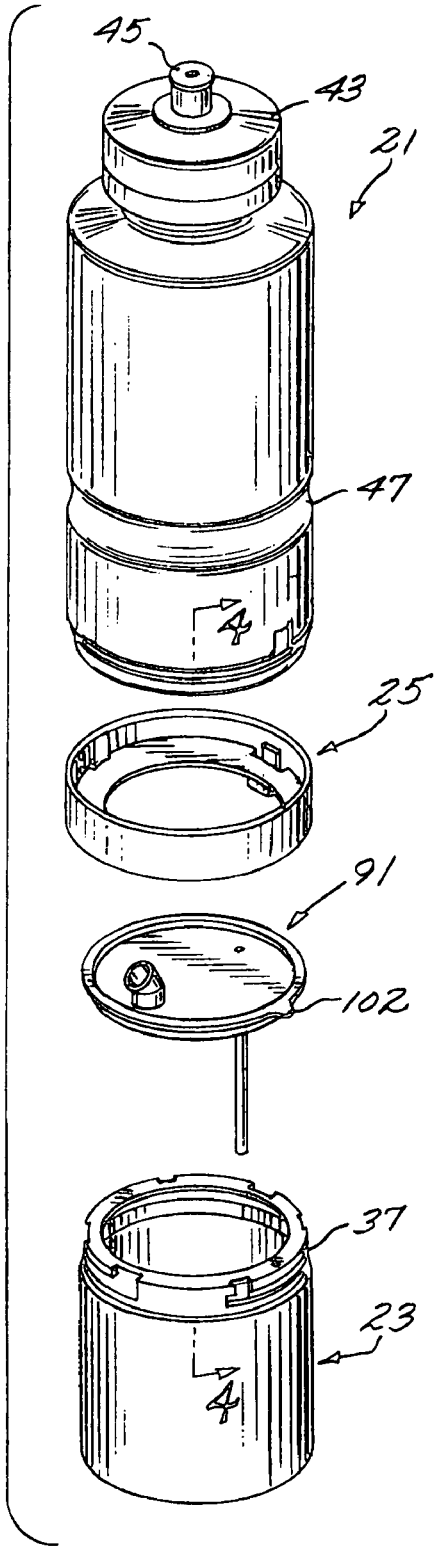
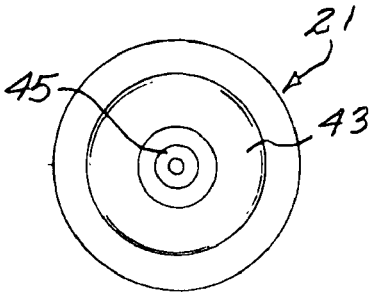
FIG. 3

COMBINATION DRINKING BOTTLE AND CONCENTRATE CONTAINER AND METHOD OF MAKING SAME

CROSS-REFERENCES TO RELATED APPLICATIONS

This is a non-provisional claiming priority to provisional application No. 60/880,001, entitled Re-Fresh Sports Bottle, filed on Jan. 11, 2007, and provisional application No. 60/898,630, entitled Re-Fresh II, filed on Feb. 1, 2007 which are hereby incorporated by reference in their entirety.

BACKGROUND OF THE INVENTION

1. Field of the Invention

The present invention relates to beverage bottles typically referred to as sports bottles.

2. Description of the Prior Art

With the advent of a health conscious society, sports bottles have become particularly popular for carrying hydration beverages, electrolyte rich fluid for flavored or high energy drinks. These bottles are often constructed of plastic material and are typically single fill bottles such that once the contents have been consumed, the bottles themselves are frequently disposed of and find their way to landfills or the like thus contributing significantly to the bulk of discard in the landfills.

Efforts have been made in various areas to provide for a convenient dispensing bottle with a container of liquid, such as water, attached thereto. Such devices typically incorporate some type of communication valve or the like which is manually operable to open communication from the water reservoir to the baby formula bottle for introduction of water to be consumed by the newly fed baby. Such devices have been proposed with a male connector plug externally threaded on opposite ends for threadable connection between the baby bottle and a reservoir and incorporating the manually operable valve. A device of this type is shown in U.S. Patent Application No. 2007/0017890 filed Jun. 25, 2005. Such devices, while having utility for direct communication between a water reservoir and interior of a baby bottle, suffer the shortcoming they are relatively expensive to manufacture, are cumbersome and, with reuse, sometimes encounter sanitation challenges.

Participants and spectators alike at various sporting events and gathering places often times carry beverage bottles with them. Frequently, the beverage bottles are carried in backpacks or sometimes mounted to the frame of a bicycle or the like. Athletes are often clad in tight fitting uniforms without pocket space for carrying necessary items such as car keys, credit cards, cell phones or the like for easy access. Thin wall molded water bottles have been proposed with an external screw thread on the bottom to connect with an interior screw thread of a storage cup for storage of car keys and the like. A water bottle of this type is available from Hangzhou Everich Houseware Co., Ltd. While providing for convenient storage of car keys and the like, the screw thread connection of the cup is typically not designed to provide a water tight seal for carrying liquid or fine powder concentrate in the cup for repeated unthreading thereof for access to refill concentrate from a cup.

SUMMARY OF THE INVENTION

A combination bottle and concentrate container including a beverage bottle configured on its bottom end with a peripheral connector groove, a concentrate cup, opened at one end and formed adjacent to one end with a connector lip for releasably engaging the connector groove and a connector ring interposed between the bottle and cup and formed on one extremity with a lip for releasably engaging the connector groove and on its opposite end with a female coupling element for releasably engaging the cup.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 1 is a perspective view of a combination beverage bottle and concentrate cup embodying the present invention;

FIG. 2 is an exploded perspective view of the combination bottle concentrate cup shown in FIG. 1;

FIG. 3 is a top view of the combination shown in FIG. 1;

DETAILED DESCRIPTION OF THE PREFERRED EMBODIMENTS

Figure 16:
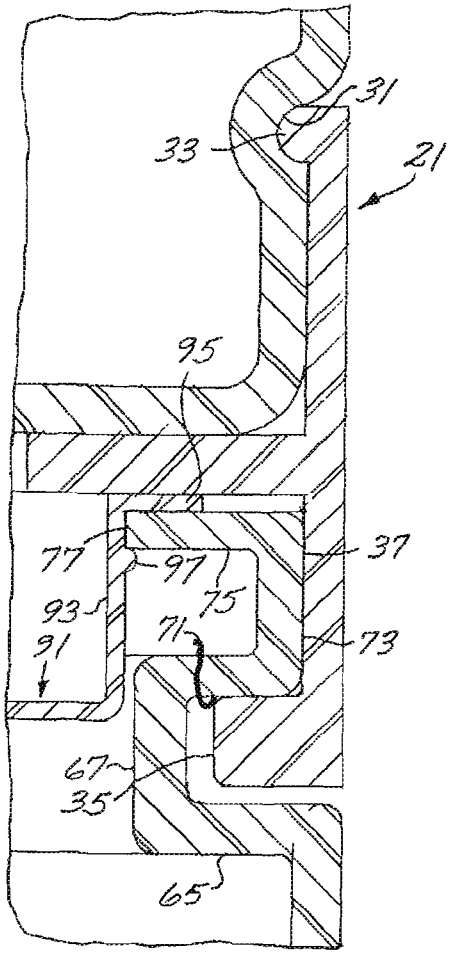
FIG. 16 is a detail vertical sectional view, in enlarged scale, taken from the ellipse designated FIG. 16 in FIG. 12.

Referring to FIGS. 1, 2 and 16, the combination drinking bottle and concentrate container 11 of the present invention includes, generally, a drinking bottle 21, an open top container cup 23 for receiving a recharge of concentrate and a coupling ring 25 interposed therebetween. The bottle 21 may be formed in its lower extremity with a radially outwardly opening snap groove 31 and the coupling ring 25 may include a laterally inwardly turned connector lip 33 (FIG. 16). The ring may include in its lower extremity a plurality of radially inturned coupling teeth 35 received behind respective coupling ribs 37 in the container cup.

Sports bottles have become popular with all segments of the public interested in a healthy life style and particularly those dedicated to fitness and training. Such sports bottles are often utilized to carry a beverage which may be an energy drink or other type of fluids for adding electrolytes or other liquids for hydration. Such sports bottles are typically single use thus resulting in discard when they become empty thereby contributing significantly to the bulk added to landfills each year. Thus, it is desirable to provide an economical and convenient combination bottle and concentrate container so that once the beverage is consumed from the bottle, the cap may be decoupled so that concentrate may be poured from the container cup into the bottle to be mixed with water or the like to thereby provide a refill thus continuing utilization of the same bottle.

The bottle 21 of the present invention may be constructed of any one of a various types of plastics and preferably of high density polyethylene. It will be sized for the particular application and will preferably have a volume of about 18 ounces to provide a convenient volume for mixing and to establish a reasonable supply of drinking beverage.

In one preferred embodiment, the combination of the present invention is of molded construction and the wall of the bottle and container cup may be relatively thin, on the order of 1/32" thick and certainly less than 1/16" of an inch thick and may be contoured to a generally cylindrical configuration. The bottle 21 is molded at its upper extremity with an annular, upwardly facing shoulder 41 surrounding an upstanding threaded neck for receipt of a cap 43 having a conventional valved drinking nozzle 45 mounted centrally thereon.

The bottle 21 is configured intermediately along its length with a radially inwardly indented groove defining a waist 47. The bottle is configured at its bottom extremity with an undercut to define a reduced in diameter cylindrical boss 51 (FIG. 4) formed at its upper extremity with the further undercut snap groove 31. It will be appreciated that the snap groove 31 may be in the form of one or more discontinuous grooves or, a continuous peripheral groove. The boss 51 is formed with three axially projecting open ended indexing slots 53 spaced equidistance thereabout.

The coupling ring 25 is configured with a cylindrical peripheral wall 55 of a diameter to be slip fit in female relationship over the boss 51 and is formed at its upper extremity with a radially inturned segments defining the locking lip 33 received in snap fit relationship in the groove 31.

Figure 4:
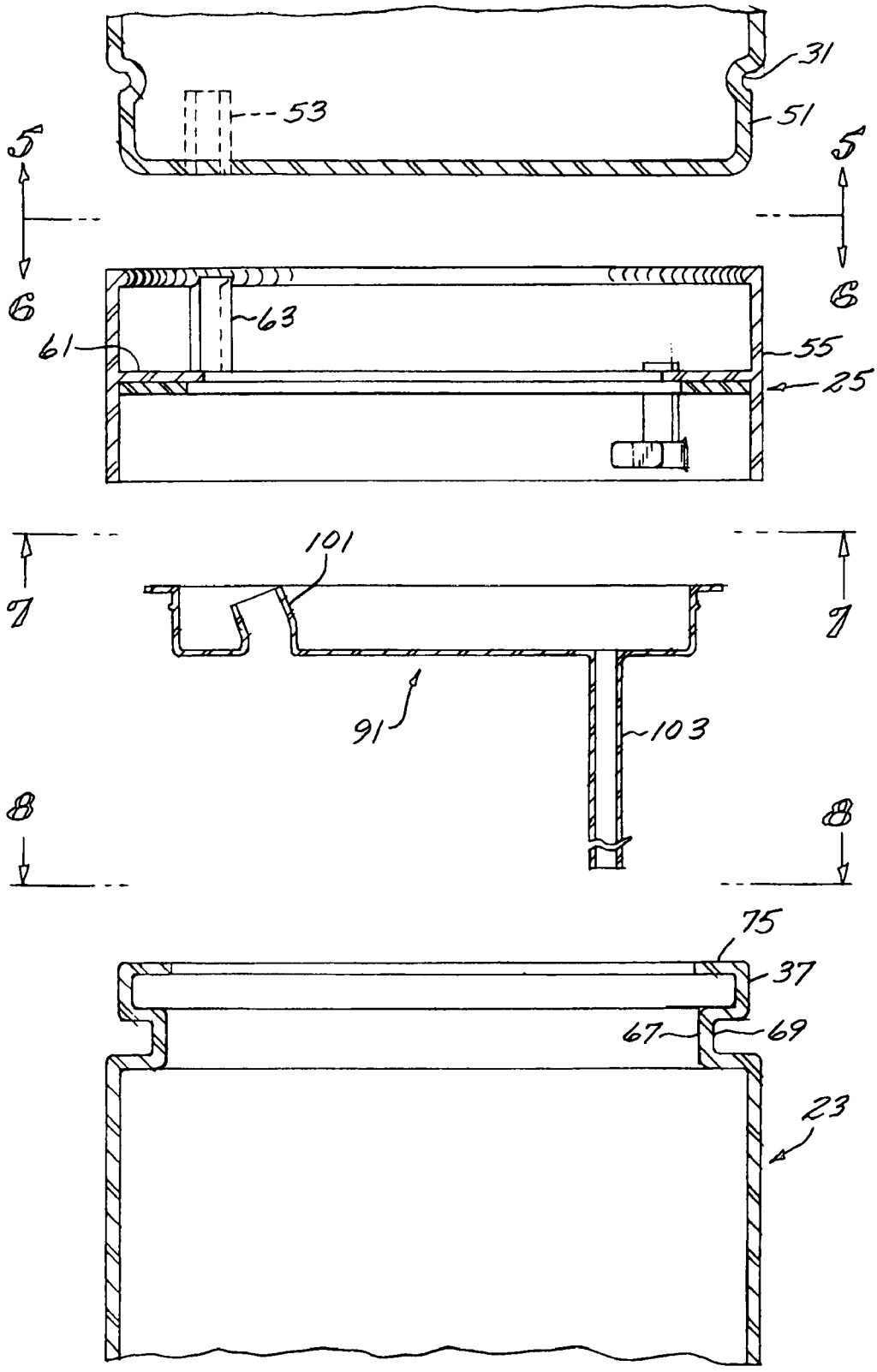
FIG. 4 is a longitudinal sectional view, in enlarged scale, taken along the lines, line 4-4 of FIG. 2.
Figure 5:
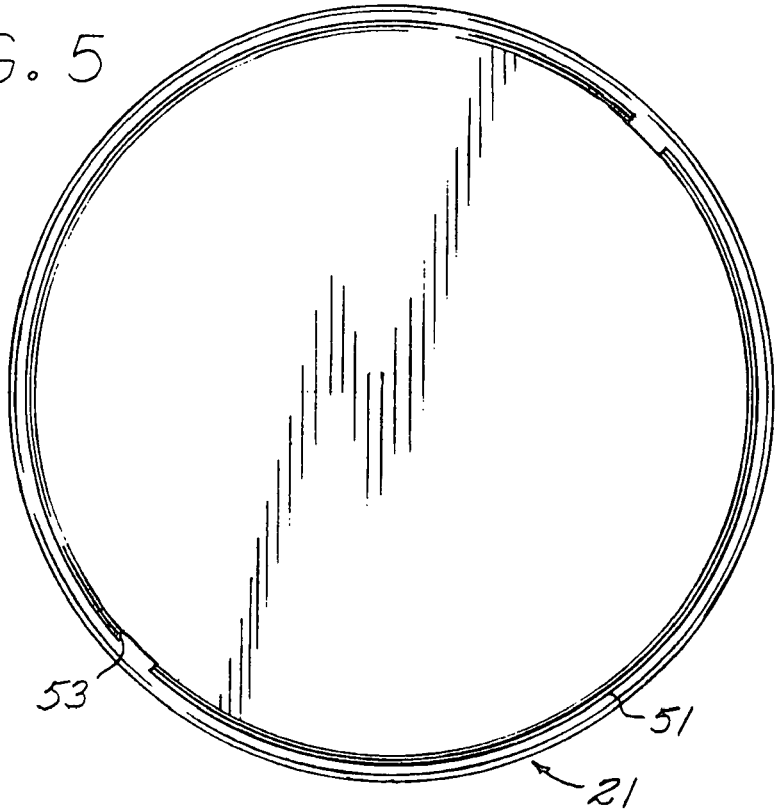
FIGS. 5, 6, 7 and 8 are transverse sectional views taken along the respective lines 5-5, 6-6, 7-7, and 8-8 of FIG. 4.
Figure 6:
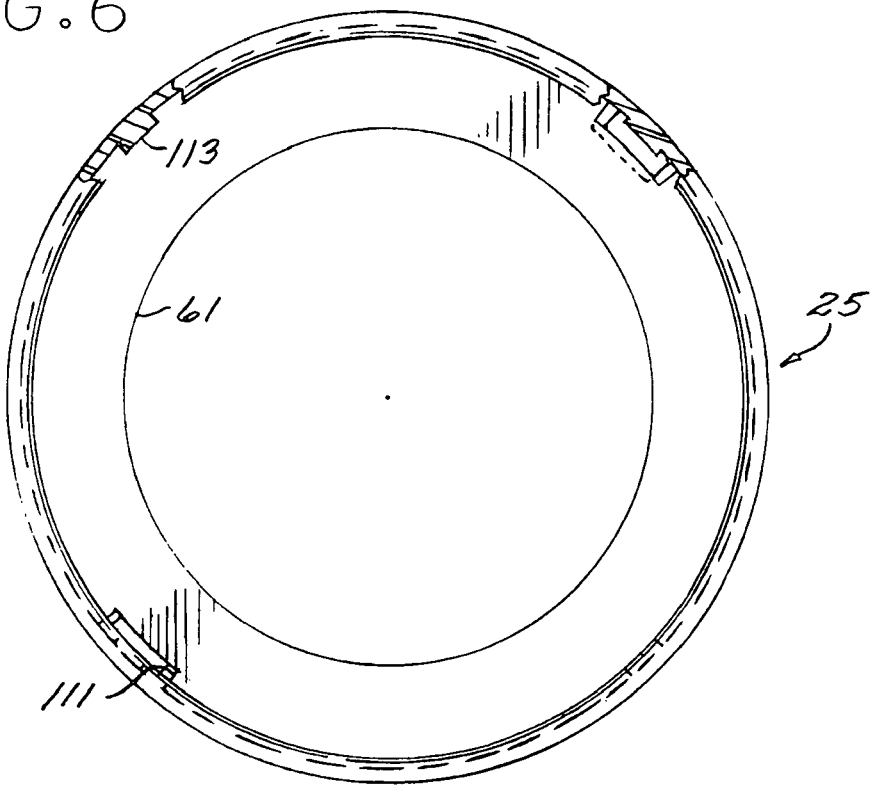
Figure 7:
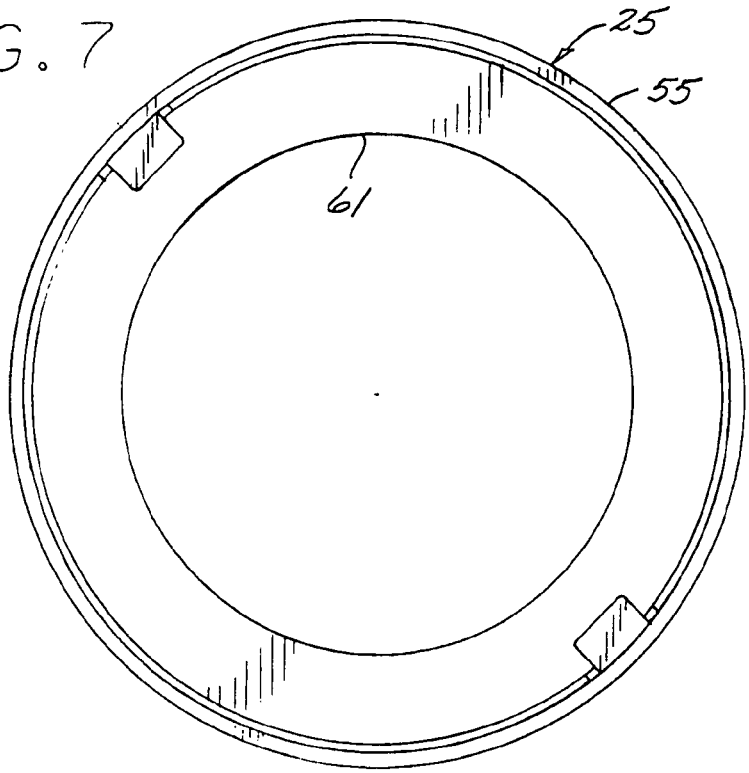
Figure 8:
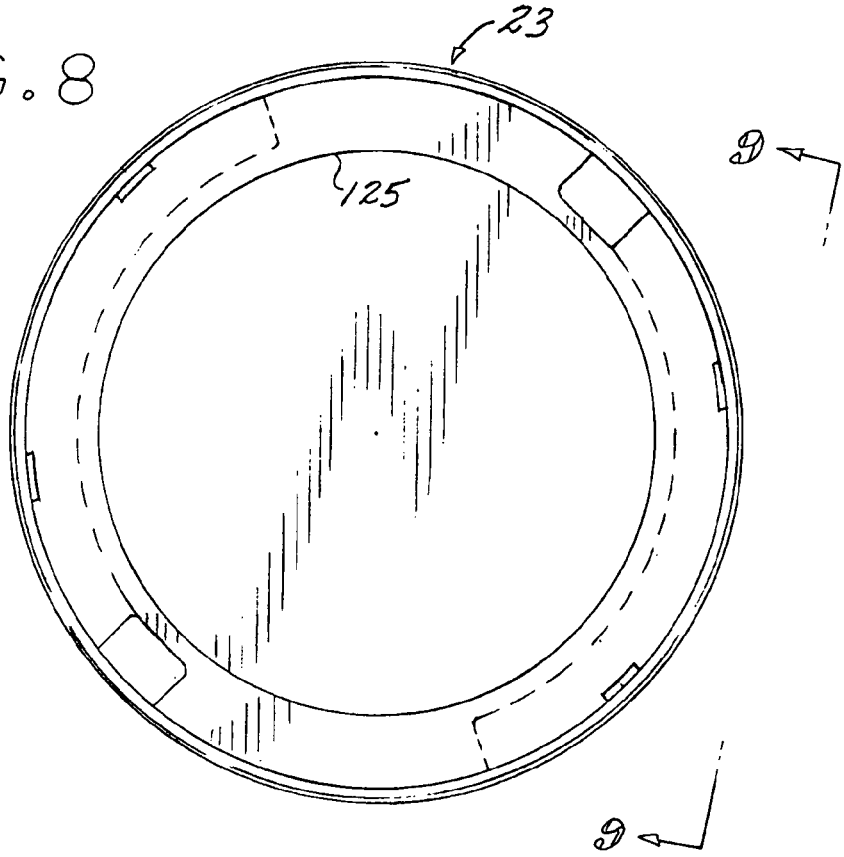
Figure 13:
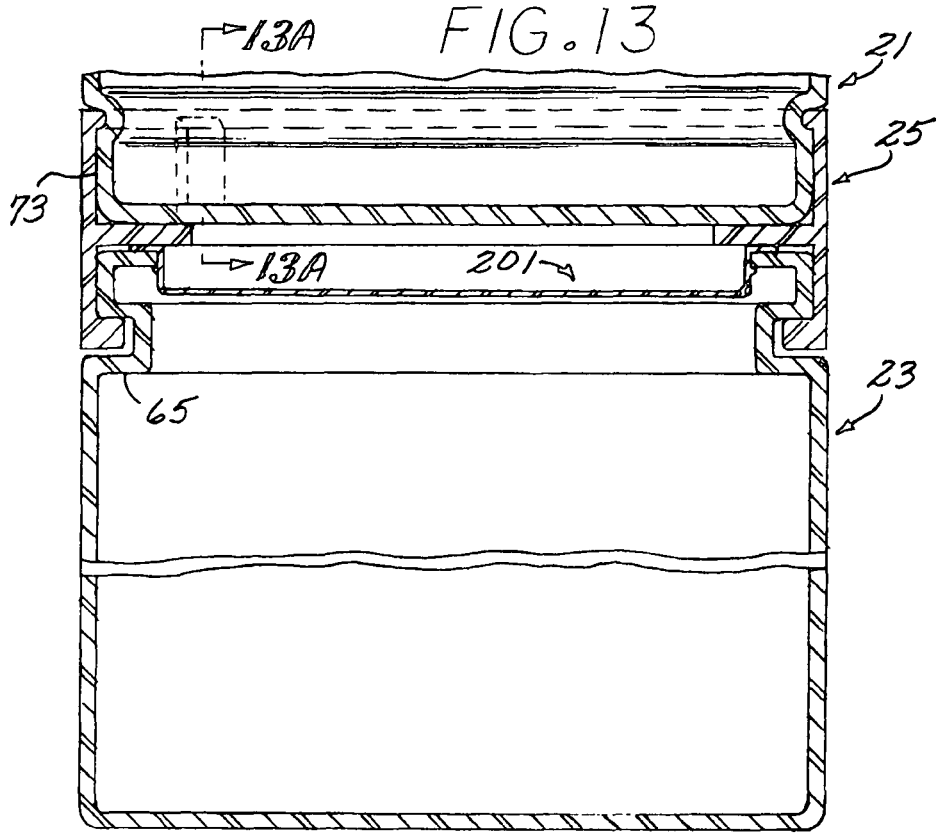
FIG. 13 is a broken vertical sectional view similar to FIG. 12 but depicting a modified cup lid.
Figure 13A:
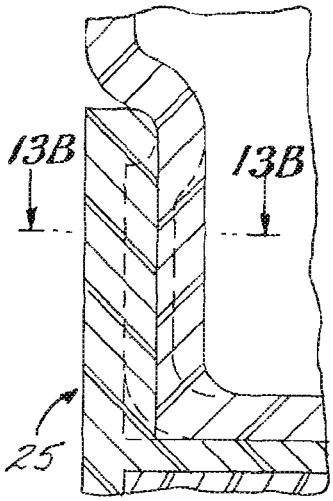
FIG. 13A is a vertical sectional view, in enlarged scale, taken along the line 13A-13A in FIG. 13.
Figure 13B:
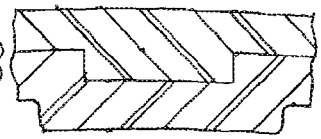
FIG. 13B is a horizontal sectional view taken along the line 13B-13B in FIG. 13A.

Referring to FIGS. 4 and 16, the ring 25 is formed medially with a radially inwardly projecting, horizontal flat annular band 61, configured to be nested against the bottom wall of the boss 51 when the lip 33 are received in snap fit relationship within the groove 31. Formed on the inside of the peripheral wall 55 are a plurality of axially extending index strips 63 spaced thereabout and sized to be received in their upper extremities in slip fit relationship within the index slots 53 (FIGS. 4, 13A and 13B) to lock the ring against rotation relative to the boss 51.

The peripheral wall 55 of the ring is formed in its lower extremity with a plurality of radially inturned teeth 35 to facilitate coupling to the cup 23.

Referring to FIGS. 4 and 16, the cup 23 is of generally cylindrical configuration and is formed in its upper extremity with the circumferential ribs 37 about 1/8"-1/4" inches wide in the axial direction of the cup. Such coupling ribs are molded in the thin wall of the cup with a longitudinal cross section in the shape of a reverse "S" to be turned radially inwardly to form a horizontal flange 65 (FIG. 16) which then turns upwardly to form a reduced-in-diameter neck 67 defining a radially outwardly opening groove 69 at least 1/8" high and preferably a little over 1/4" of an inch high and formed to receive with the respective teeth 35. In this regard, the wall of the cup projects upwardly and turns radially outwardly at the top of the neck to form a radial extent defining a downwardly facing radial surface 71. The wall of the cup then turns upwardly to form a barrel 73 and then turns radially inwardly to form a relatively rigid closure flange 75 terminating at an annular inner edge 77 to define a latch edge of a predetermined diameter. As will be recognized by those skilled in the art, for this embodiment with the thin wall it is only important that the rib 37 have sufficient size and structural integrity to carry the load applied by the coupling teeth to establish a secure and tight coupling.

Figure 9:
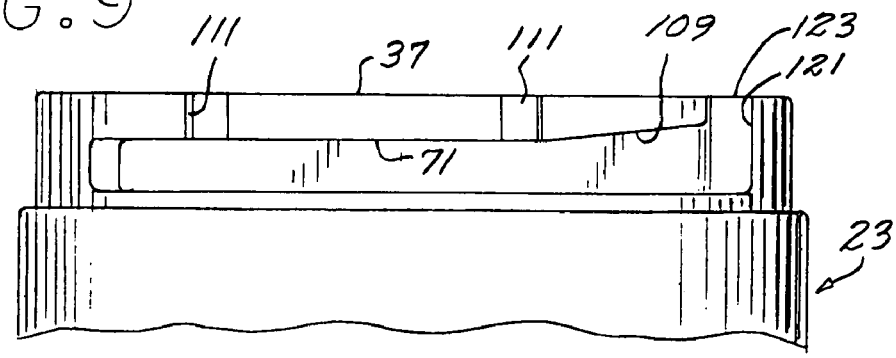
FIG. 9 is a partial side view, in enlarged scale, of the upper portion of the cup shown in FIG. 2.
Figure 10:
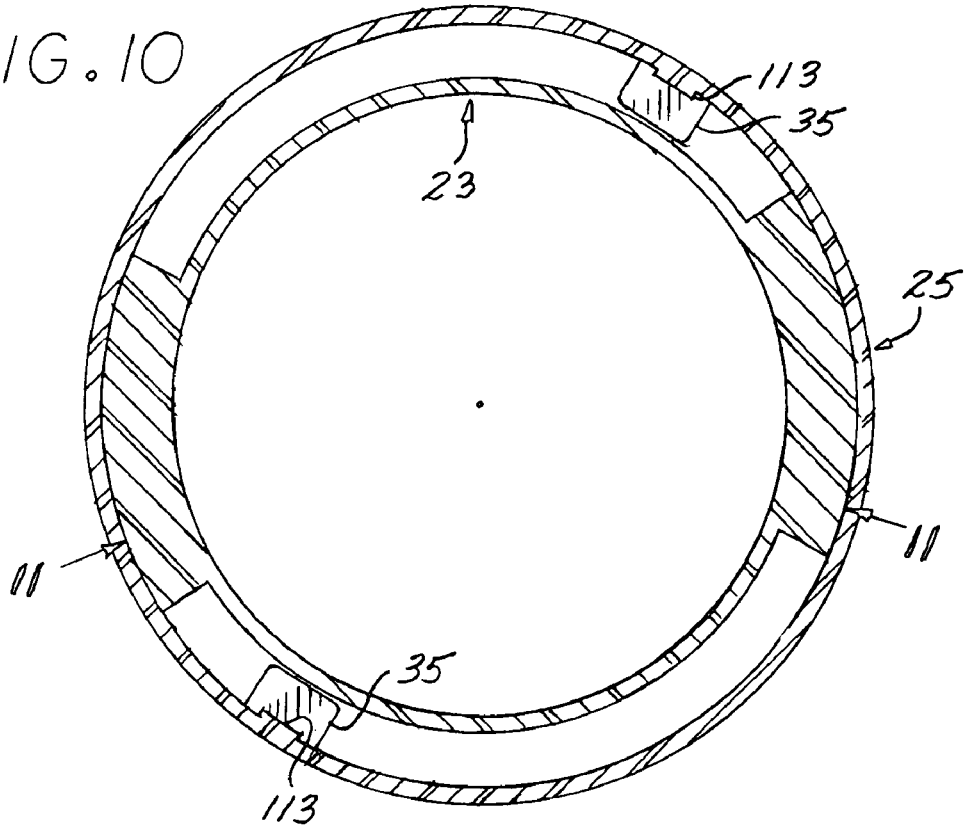
FIG. 10 is a transverse sectional view, in enlarged scale, taken along the line of 10-10 of FIG. 1.
Figure 11:
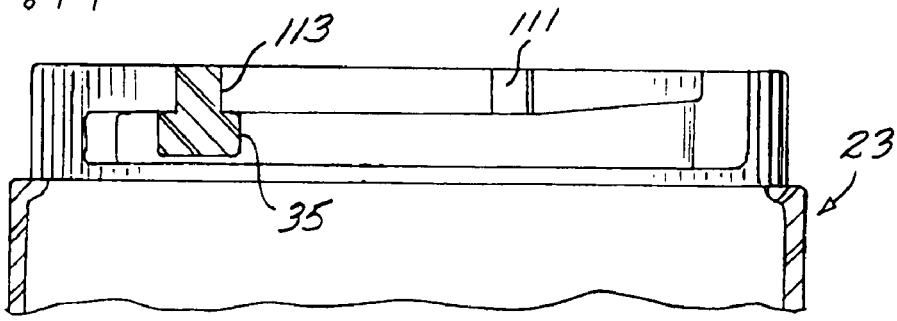
FIG. 11 is a sectional view taken along the line 11-11 of FIG. 10.

Referring to FIGS. 9-11, the ribs 37 are formed throughout the majority of their circumferential length with the downwardly facing radial surface 71 but then taper upwardly toward their respective free ends a distance of about 1/4" in the axial direction to form respective inclined cams 109 and terminate at circumferential ends 121 of the respective grooves to cooperate in forming vertically upwardly opening access notches 123 for selective receipt of the respective teeth 35 to be engaged underneath the ramps 109 as the cup is rotated relative to the bottle. As the cup is rotated, the respective teeth 35 will be operative to draw the cup upwardly about a quarter of an inch into pressing relationship by a little less than 1/4 of a revolution, respective axial strips 113 will register with the respective slots 111 to releasably lock rotational position relative to the bottle to maintain it locked there against.

With continued reference to FIGS. 4 and 16, a circular lid, generally designated 91 is configured with axially extending barrel 93 of a selected outside diameter to be received in telescopical relationship within the opening defined by the annular edge 77 of the flange 75 and is formed at its top extremity with a radially outwardly projecting flange 95 nested over the top of the flange 75. The barrel 93 is formed in its outside diameter with a flexible fastener bead 97 spaced from the flange 95 a distance corresponding with the thickness of the flange 75 to thereby cooperate in holding the lid in snap fit sealing relationship on the cup 23.

Figure 12:
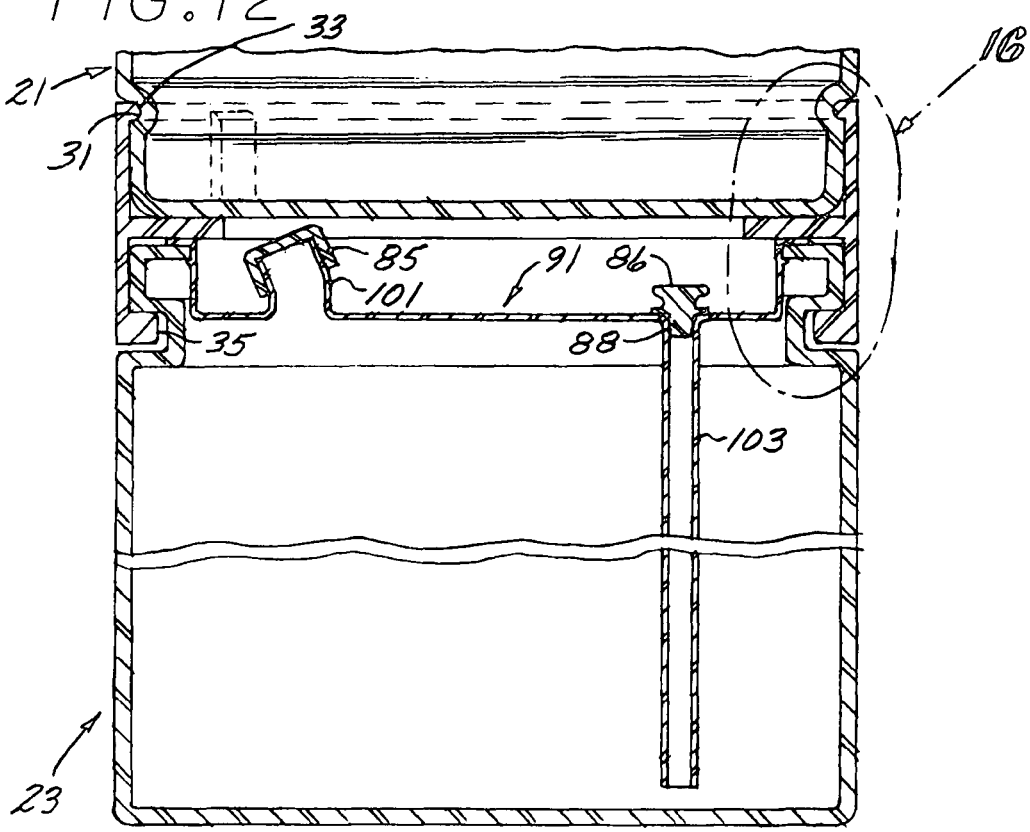
FIG. 12 is a vertical sectional view, in enlarged scale, taken along the line 12-12 of FIG. 1.

Referring to FIGS. 2, 4 and 12, the lid 91 is conveniently formed in the wall found by the barrel with an upwardly projecting dispenser spout offset eccentrically to one side thereof and a downwardly projecting breather spout 103 disposed eccentrically to the opposite side thereof and projecting downwardly into the cup. The lid is formed at one side with a radially outwardly projecting pull tab 102.

A tubular cap 85 is received in friction fit sealing relation over the top end of the spout 103 and a friction fit plug 86 is formed with a male nipple 88 received in friction fit in the top end of the tube 103.

In operation, the bottle 21, cup 23, ring 25 and lid may be molded from flexible plastic such as polyethylene. The combination may then be assembled together by grasping the coupling ring 25 and pressing it upwardly on the boss 51 shown in FIG. 4 to compress the wall of the boss slightly radially inwardly to allow lip 33 to register in the coupling groove 31, it being appreciated that the respective lugs 63 will be registered with the slots 53.

A charge of concentrate, baby formula, water or the like may be inserted in the cup 23 and the lid 91 placed there over by inserting the barrel 93 downwardly into the top of the cup and pressing downwardly to flex the latching bead 97 and wall of the barrel radially inwardly so such bead can pass axially downwardly past the annular edge 77 of the flange to clear such flange allowing the flange to nest in sealing relation in the annular groove formed between the bead and the underside of the flange 95 (FIG. 16). This will then serve to capture any liquid or powder concentrate sealed in the cup. The cup 23 may be slid upwardly into the lower end of the ring 25 and rotated to engage the respective slots 123 (FIG. 9) in axial alignment with the respective teeth 35 for entry thereof into horizontal alignment with the grooves formed on the underside of the respective cam surfaces 109 (FIG. 9). The cup may then be quickly and easily rotated counterclockwise as viewed in FIG. 10 to orbit the ribs 37 within the interior of the ring to engage the cams 109 (FIG. 9) with the respective teeth to, as such rotation continues, draw the top edge of the cup toward the bottle (FIG. 16). Rotation of the cup will be continued until such time as the respective strips 113 register with the respective slots 111 to thus give a tactile indication that the cup is locked onto the bottle.

The bottle 21 may then be used in a conventional manner. When the athlete desires hydration or re-energization he or she may access the valved nozzle 45 for a reconstituted beverage. When the bottle 21 is emptied, it would be appreciated that the athlete may quickly and easily disconnect the cup 23 by rotating it clockwise as shown in FIG. 10 relative to the bottle to disengage the respective strips 113 from the slots 111 and register the respective teeth 35 in axial alignment with the respective access slots 123 for disengagement thereof. The athlete may then remove the cover 43 of the bottle and the cap 85 from the pouring spout 101 and the plug 86 from the breather tube. The pouring spout 101 will then be aligned over the inlet to the bottle to pour the desired quantity of concentrate from the cup into the bottle. The cap 85 and plug 86 can then easily be fitted in place and the cup threaded back unto the ring 25 to maintain it in its coupled position. Access may then be had to water from a water fountain or the like which may be available in any park or rest area to fill the bottle and provide the desired degree of reconstitution.

This process may then be repeated until such time as the concentrate has been depleted from the cup 23. Then with the cup decoupled from the ring 25 and the athlete may grasp the tab 102 (FIG. 2) to seal the lid upwardly to disengage it from the cup so that a new supply of concentrate may be added to the cup. In some embodiments, the concentrate or supplement may be conveniently packaged in cup 23 and the entire cup may be replaced to render the new supply of concentrate available.

Figure 14:
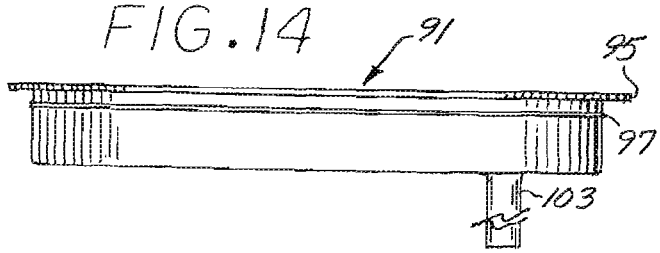
FIG. 14 is a broken side view of a cup lid incorporated in the combination bottle and concentrate cup shown in FIG. 12.
Figure 15:
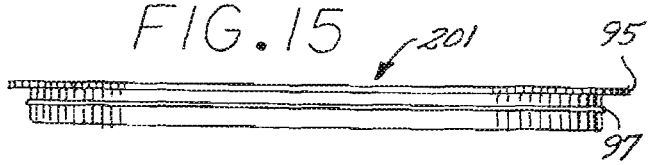
FIG. 15 is a side view of a lid incorporated in the combination bottle and concentrate cup shown in FIG. 13.

Referring to FIG. 15 will be appreciated that the lid, generally designated 201, shown therein is substantially the same as that shown in FIG. 14 except that there is no breather tube or discharge spout thus leaving the athlete to remove the lid each time access is to be had to the concentrate.

Figure 17:
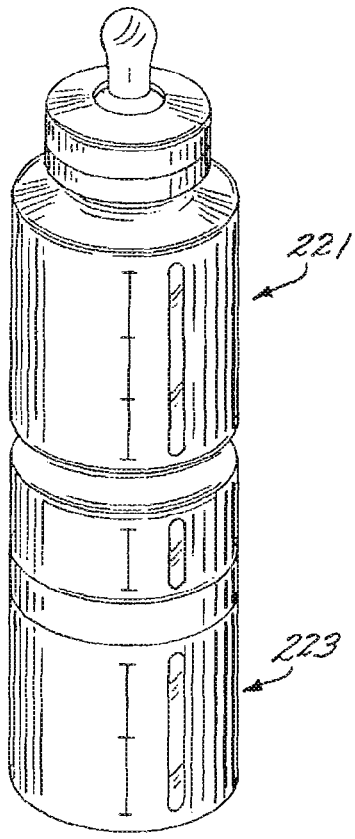
FIG. 17 is a perspective view of a combination baby bottle and concentrate cup embodiment of the present invention.

Referring to FIG. 17, the baby bottle shown therein is substantially the same as the construction for the bottle shown in FIGS. 1 and 2, being recognized that the cup 223 may contain water or the like to be poured into the bottle 221 upon depletion of the formula or the like.

As will be appreciated by those skilled in the art, the bottle cap 43 may take many different forms, such as a squirt or pour spout or, in some embodiments, a spray nozzle.

From the foregoing, it will be apparent that the combination beverage bottle and concentrate of the present invention provides an economical and effective means for making and assembling a concentrate cup for convenient coupling to a beverage bottle and which is convenient to use and provides for a sanitary and orderly containment of concentrate ready for addition to the beverage bottle.

We claim:

1. A combination sports beverage bottle and concentrate cup comprising:

an elongated, upright, cylindrical, molded plastic bottle formed with peripheral wall and a closed bottom wall, the peripheral wall configured with an upper extremity forming an outlet and a lower extremity defining a radially outwardly opening annular latch groove spaced longitudinally from the bottom wall, the peripheral wall further configured in its lower extremity with longitudinal, laterally outwardly facing registration slots;

an upright cylindrical, plastic cup adjacent the closed bottom wall of the bottle, molded with a cup bottom wall, open top end and a peripheral cup wall reduced in diameter adjacent the top end to form a radially outwardly opening locking groove, and projecting upwardly there from to be formed on its opposite sides with enlarged in diameter circumferential rib segments having respective bottom annular walls defining cam surfaces and spaced circumferentially apart to terminate in respective adjacent radial ends cooperating to form therebetween respective axial access openings spaced about the peripheral wall, the respective cam surfaces angling downwardly in one circumferential direction from respective one ends of the rib segments, the peripheral cup wall turning radially inwardly from the upper sides of the respective rib segments to form an annular stop flange;

a circular lid device on the cup and formed with a radially outwardly flared closure flange overlying the stop flange;

a cylindrical connector ring device formed with a peripheral band encircling the bottom extremity of the bottle and the top of the cup, formed on it inner wall with an annular ring flange sandwiched between the cup bottom wall and the closure flange, the band including interior, longitudinal registration strips slidably received in the respective registration slots, the band further being formed at its upper extremity with a radially in-turned lip configured to engage the latch groove to latch the ring device on the bottle, the ring device further formed in it its lower extremity with laterally in-turned teeth to be received axially in the respective access openings and so configured as to, when the cup is engaged with the ring device and rotated in the direction opposite the one direction relative to the ring, ride downwardly on the respective cam surfaces to draw the cup toward the bottle to press the closure flange axially against the ring flange and cup bottom wall.

2. The combination beverage bottle and cup as set forth in claim 1 wherein:

the cup includes a first index element; and the ring device includes a second index element for releasably engaging the first index element to indicate when the cup is in a selected rotational position relative to the ring.

3. The combination beverage bottle and cup as set forth in claim 2 wherein:

the peripheral wall of the cup is formed with the rib segments having an axial dimension of between ⅛th and ¼th of an inch and are so configured that, when the cup is engaged with the ring device and the respective teeth received though the access openings, and the cup rotated in the direction opposite the one direction relative to the ring device substantially ¼th of a full rotation, the second index element will engage with the first index element.

4. The combination beverage bottle and cup as set forth in claim 1 wherein:

the cam surfaces and teeth are so arranged that, upon engagement of the cup with the ring device and rotation of the cup ¼th of a full rotation in the direction opposite the one direction, the teeth will ride along the respective cam surfaces to draw the cup substantially ¼th of an inch axially toward the bottle.

5. A combination sports beverage bottle and concentrate cup comprising:

an elongated, upright thin wall cylindrical molded plastic bottle formed with a cylindrical peripheral wall and a closed bottom wall, the peripheral wall configured in the upper extremity with an outlet and on the bottom extremity with a reduced in diameter boss configured with a circumferential wall having a radially outwardly opening an annular latch groove spaced longitudinally from the bottom wall, the cylindrical peripheral wall further configured with longitudinal, radially outwardly facing, downwardly opening registration slots;

a thin wall plastic cup molded with a bottom wall, open top end and a cylindrical peripheral cup wall formed to turn laterally inwardly in its upper extremity to form a laterally outwardly opening locking groove, and projecting upwardly there from to from annular ribs segments having respective bottom walls defining cam surfaces and spaced circumferentially apart to terminate in circumferential ends spaced apart to form therebetween respective axial access openings spaced about the peripheral wall, the respective cam surfaces angling circumferentially downward in one direction from the respective circumferential ends and the cup wall projecting upwardly from the level of the rib segments toward the bottle to turn radially inwardly to form a closure flange terminating in a latch edge defining a circular opening;

a lid configured with a cylindrical wall defining a barrel configured to be complementally received downwardly in the circular opening and flared radially outwardly at its upper extremity to form a lid flange overlying the closure flange, the barrel formed on its radially outer surface with a flexible radially outwardly projecting annular fastener bead constructed to releasably interfit under the latch edge;

a tubular connector ring device formed with peripheral band encircling the bottom of the boss and top end of the cup and including an annular stop flange sandwiched between bottom wall and the lid flange and further including longitudinal registration strips slidably received in the respective registration slots, the ring device further being formed at its upper extremity with a radially in-turned lip configured to engage the latch groove to lock the ring device on the bottle, the ring device further formed in it its lower extremity with radially in-turned teeth to be received axially in the respective access openings and so configured as to, when the cup is engaged with the ring device and rotated in the circumferential direction opposite the one direction relative to the ring device, ride downwardly on the respective cam surfaces to draw the cup toward the bottle to press the closure flange axially toward the boss to compress the stop flange.

6. A combination sports beverage bottle and concentrate cup as set forth in claim 5 wherein:

the cam surfaces slope at an angle sufficient to provide an axial differential from one circumferential end to the other of substantially $\frac{1}{4}^{th}$ of an inch.

* * * * *